US005922993A

United States Patent [19]

Ide et al.

[11] Patent Number: 5,922,993

[45] Date of Patent: Jul. 13, 1999

[54] COVERED WIRE CONNECTION STRUCTURE

[75] Inventors: Tetsuro Ide; Nobuyuki Asakura, both of Shizuoka-ken, Japan

[73] Assignee: Yazaki Corporation, Tokyo, Japan

[21] Appl. No.: 08/867,845

[22] Filed: Jun. 3, 1997

[30] Foreign Application Priority Data

Jun. 4, 1996 [JP] Japan ..... 8-141880

[51] Int. Cl.[6] ..... H01R 4/00

[52] U.S. Cl. ..... 174/84 R

[58] Field of Search ..... 174/84 R, 94 R, 174/72 C

[56] References Cited

U.S. PATENT DOCUMENTS

| | | | |
|---|---|---|---|
| 2,250,156 | 7/1941 | Ferguson | 174/84 R X |
| 3,418,444 | 12/1968 | Ruehlemann | 174/84 R X |
| 3,510,624 | 5/1970 | Bennett | 174/84 R X |
| 3,910,448 | 10/1975 | Evans et al. | 174/66 X |
| 3,946,145 | 3/1976 | Warner | 174/94 R |
| 4,878,969 | 11/1989 | Janisch | 174/84 R X |
| 5,057,661 | 10/1991 | Banner | 219/56.22 |
| 5,584,122 | 12/1996 | Kato et al. | 174/84 R X |

FOREIGN PATENT DOCUMENTS 7-320842 12/1995 Japan .

*Primary Examiner*—Dean A. Reichard
*Attorney, Agent, or Firm*—Finnegan, Henderson, Farabow, Garrett & Dunner, L.L.P.

[57] ABSTRACT

Two covered wires conductively connected with each other are overlapped with each other at connection portions. The overlapped connection portions are pinched by a pair of resin chips. Cover portions are melted and pressurized from the outside of resin chips capable of obtaining a sealing condition and providing an excellent melting operation efficiency so as to connect conductive wire portions conductively at the connection portions. Then, the pair of the resin chips are melted together to seal the connection portions. In introducing end portions in which a covered wire is introduced out of the resin chips, between a melting surface relative to a mating resin chip and an outer peripheral surface, a round corner having a curvature continuously changing smoothly is provided. Thus, it is possible to obtain a sealing condition securely and an excellent melting operation efficiency.

10 Claims, 5 Drawing Sheets

COVERED WIRE CONNECTION STRUCTURE

BACKGROUND OF THE INVENTION

As a conventional connection structure for this kind of covered wires, a structure designed by this inventor (see Japanese Laid-Open Patent Application No. 7-320842) will be described.

For connecting two covered wires the outer periphery of which is coated with a cover portion made of resin, at their intermediate connection portions, a pair of resin chips which are of resin material, a horn for producing ultrasonic vibration, and an anvil for supporting the covered wires and resin chips at the time of connection are utilized. The anvil includes a base stand and a support portion projecting from the base stand. The support portion is designed in a substantially cylindrical shape. The support portion has a bore portion which is opened at the opposite side to the base stand side. Two pairs of grooves are formed on the peripheral wall of the support portion so as to cross with each other substantially at the center of the bore portion. The four grooves are formed so as to open on the same side as the bore portion, extending along the projection direction of the support portion and intercommunicating with one another through the bore portion.

The pair of resin chips are designed in a disc shape having a slightly smaller outer diameter than the diameter of the bore portion of the anvil. Furthermore, an end face of a head portion of the horn is designed in a disc shape having an outer diameter which is substantially equal to or slightly smaller than that of the resin chips.

In order to connect the two covered wires to each other, both of the covered wires are overlapped with each other at the connection portion thereof and the overlapped connection portions are pinched by the pair of resin chips from the upper and lower sides of the connection portions. Specifically, one of the resin chips (the resin chip at the lower side) is inserted into the bore portion of the anvil such that the melting surface thereof is directed upward. Then, one covered wire is inserted into the pair of confronting grooves from the upper side of the inserted resin chip. Then, the other covered wire is inserted into the other pair of the confronting grooves. Finally, the other (upper side) resin chip is inserted such that the melting surface is directed downward. The covered wires are arranged in the bore portion so that the respective connection portions thereof cross each other at the center of the bore portion. Through this arrangement, the connection portions of the covered wires are pinched substantially at the center of the melting surfaces of the upper and lower resin chips respectively in the overlapping direction.

Subsequently, the cover portions at the connection portions of the covered wires are melted so as to be dispersed by ultrasonic vibration. Furthermore, the conductive wire portions (core) of the covered wires are conductively contacted with each other at the connection portion by pressurizing the covered wires from the outside of the resin chips. Thereafter, the pair of the resin chips are mutually melt-fixed at the melting surfaces to seal the connection portion.

Specifically, the head portion of the horn is inserted into the bore portion from the upper side of the finally-inserted upper (other) resin chip and placed on the upper resin chip to excite and pressurize the connection portions of the covered wires from the outside of the upper and lower resin chips between the horn and the anvil. The cover portions are first melted and the conductive wire portions of the covered wires are exposed at the connection portion between the resin chips. At this time, the melted cover portions are extruded from the center side of the resin chips toward the outside thereof because the connection portions are pressurized from the upper and lower sides, so that the conductive wire portions are more excellently exposed and surely conductively contacted with each other. Like the pressurizing direction, the direction of the excitation of the connection portions is set to be coincident with the overlapping direction of the covered wires, so that the action of extruding the melted cover portions from the center side of the resin chips to the outside thereof is promoted.

When the pressurizing and exciting operation on the connection portions is further continued after the melting of the cover portions, the resin chips are melted and the confronting melting surfaces of the resin chips are melt-fixed to each other. In addition, the outer peripheral surface portions of the cover portions which are adjacent to the conductively contacted conductive wire portions and the resin chips are melt-fixed. With this operation, the outer peripheral portions of the conductively-contacted conductive wire portions are kept to be coated with the resin chips.

However, in the above described structure, a soft conductive wire portion exposed by dispersing the cover portion is contacted with corners of the resin chips at introducing ends of the covered wire, such that melted resin covers and seals a portion between the corners of the resin chips and the cover portion. Thus, if pressurizing and excitation of the horn are increased too much to secure a sufficient melting force, the corners of the aforementioned introducing ends are strongly pressurized by the conductive wire portion when the upper and lower resin chips are melted together, so that the conductive wire portion may be damaged by the corners. Thus, to secure sealing condition of the resin chips and prevent the conductive wire portion from being damaged, it is necessary to set a melting condition (e.g., ultrasonic energy, pressure, pressurizing and excitation time, etc.) by pressurizing and excitation in details and manage it. Thus, the melting work is very complicated.

SUMMARY OF THE INVENTION

It is therefore an object of the present invention to provide a covered wire connection structure capable of securing sealing condition and providing an excellent melting operation efficiency.

In order to achieve the above object, according to the present invention, there is provided a covered wire connection structure of conductively connecting members at least one of which is a covered wire having a conductive wire portion and a cover portion formed by coating resin around an outer periphery of the conductive wire portion, the structure being formed by overlapping the members with each other and pinching an overlapping portion of the members between a pair of resin chips, pressurizing and exciting the overlapping portion pinched by the resin chips using an ultrasonic vibration welding apparatus so as to melt and disperse the cover portion, thereby to expose the conductive wire portion and electrically conductively connect the conductively wire portions of the members at the overlapping portion and so as to melt-fix the pair of resin chips to seal the connected overlapping portion of the members with the melted resin chips, characterized in that each of the resin chips includes a melting surface relative to a mating resin chip and introducing end portions in which the covered wires are introduced out of the chips, at least one of the resin chips has a curved surface portion in the introducing end portion thereof, and the curved surface portion continuously changes smoothly and is formed between the melting surface and the outer peripheral surface thereof.

According to the construction described above, in the introducing end portion, the curved surface portion extends from the melting surface to the outer peripheral surface and is formed in a shape of curvature continuously changing smoothly. Therefore, the conductive wire portion can be prevented from being damaged even if the pressurizing and excitation force is increased to secure a sufficient melting force when the resin chips are melted together and the introducing end portion is strongly pressurized by the conductive wire portion when the resin chips are melted.

The structure can be characterized in that each of the resin chips includes introducing end portions in which the covered wires are introduced out of the chips, at least one of the resin chips has a resin projecting portion in the introducing end portion thereof, and the resin projecting portion projects toward a mating resin chip and pressurizes the cover portion on the introducing end portion side when the resin chips are pressurized and excited.

According to the construction described above, the resin projecting portion is provided in the introducing end portion, ultrasonic waves are concentrated to the resin projecting portion when the resin chips are melted together so that the resin projecting portion is softened by heat generated inside. Thus, if the pressurizing and excitation force is increased to secure a sufficient melting force such that the introducing end portion is strongly pressurized against the conductive wire portion when the resin chips are melted together, the softened resin projecting portion is in contact with the conductive wire portion, so that the conductive wire portion can be prevented from being damaged.

Moreover, the structure can be characterized in that both of the curved surface portion and resin projecting portion can be provided in the introducing end portion.

Namely, according to the above constructions, if the pressurizing and excitation force is increased to secure a sufficient melting force when the resin chips are melted together so that the introducing ends are strongly pressurized by the conductive wire portions when the resin chips are melted, the conductive wire portions can be prevented from being damaged by the introducing end portions. Thus, it is not necessary to set a melting condition by pressurizing and excitation in detail and manage it, and it is possible to prevent the conductive wire portion from being damaged by a simple operation and secure a sealing condition of the resin chips.

DESCRIPTION OF THE PREFERRED EMBODIMENTS

Hereinafter, an embodiment of the present invention will be described with reference to the accompanying drawings.

Figure 1:
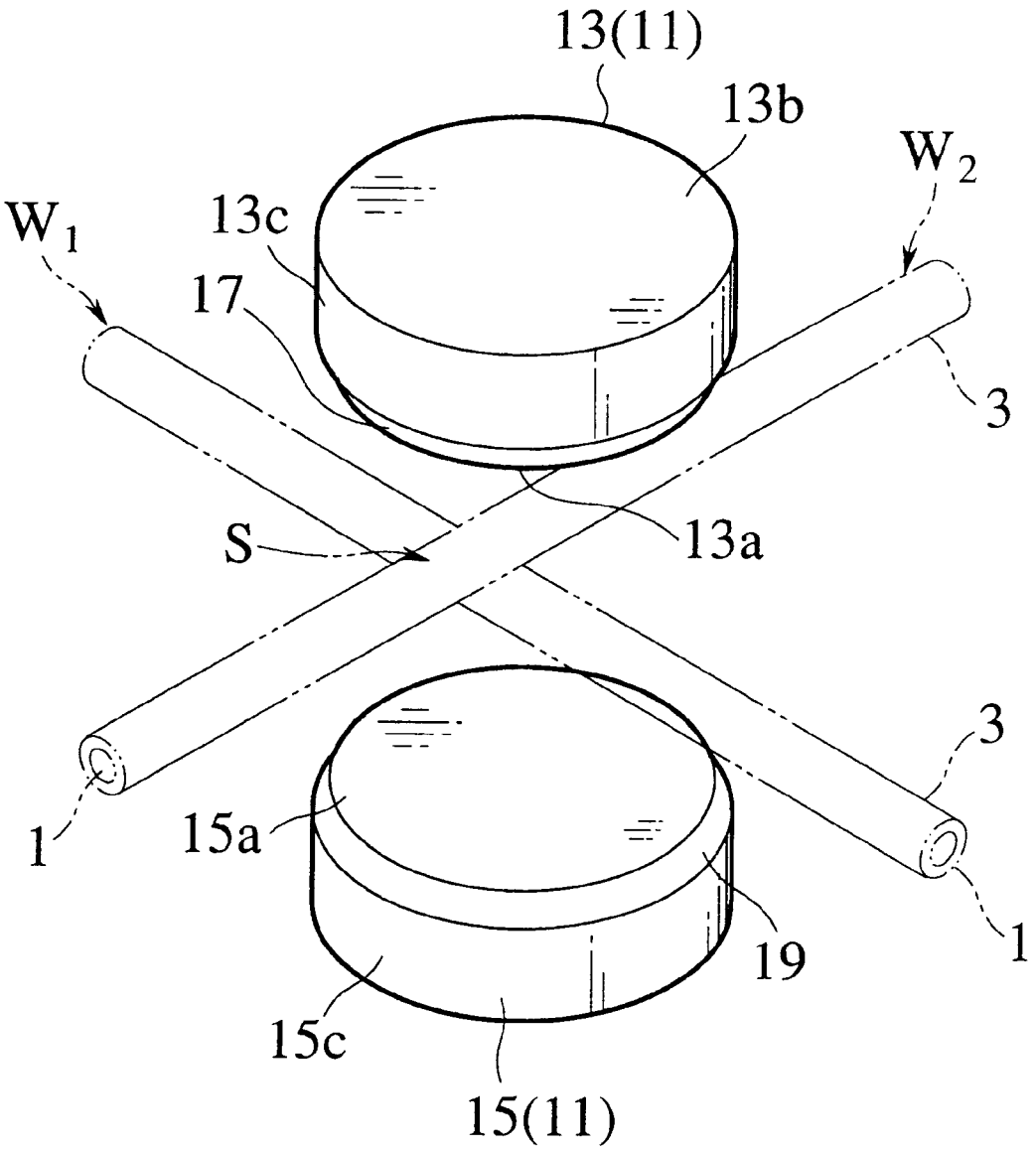
FIG. 1 is a perspective view of a state in which upper and lower resin chips are separated showing a covered wire connection structure according to a first embodiment of the present invention.
Figure 2:
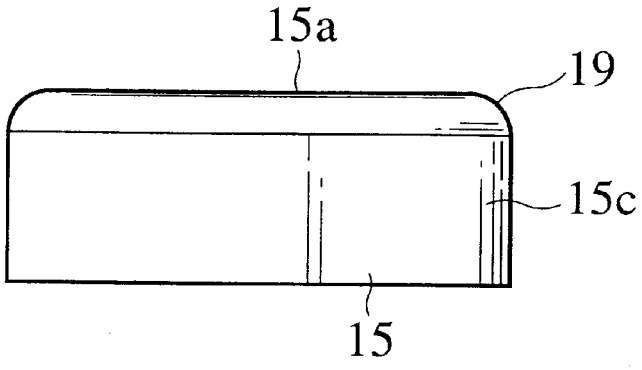
FIG. 2 is a side view of a lower resin chip.
Figure 3:
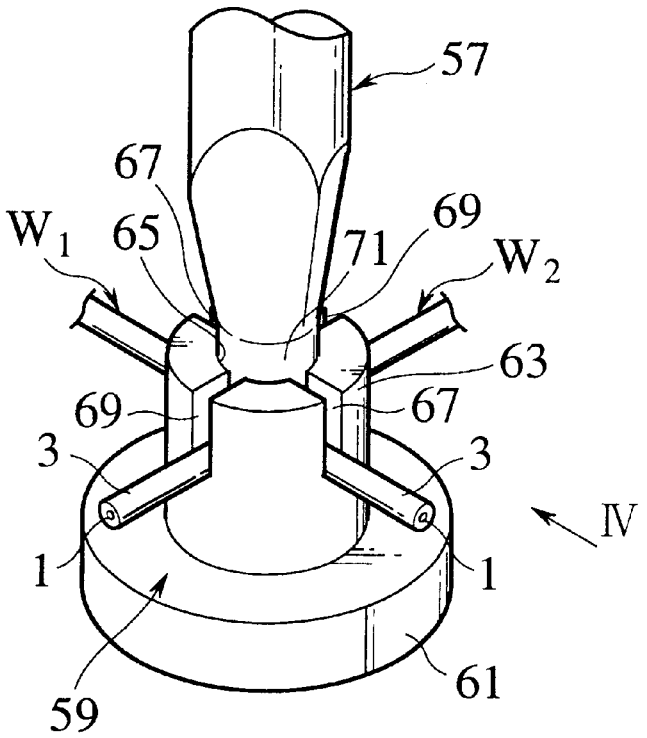
FIG. 3 is a perspective view of a state just after connection is started showing a means for obtaining the covered wire connection structure according to the first embodiment.
Figure 4A:
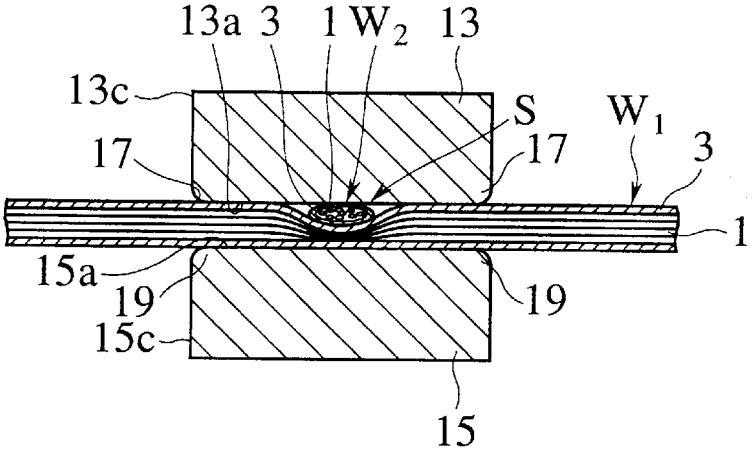
FIG. 4A is a partial cross-section of the structure of FIG. 3 showing a state just after connection is started.
Figure 4B:
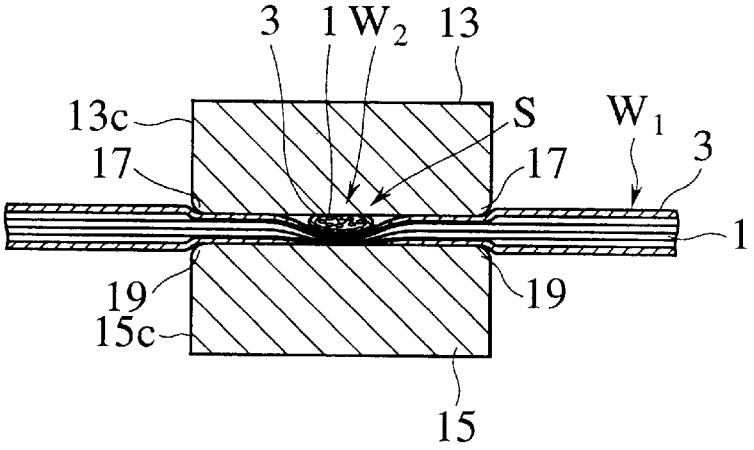
FIG. 4B is a partial cross-section of the structure of FIG. 3 showing a state during connection.
Figure 4C:
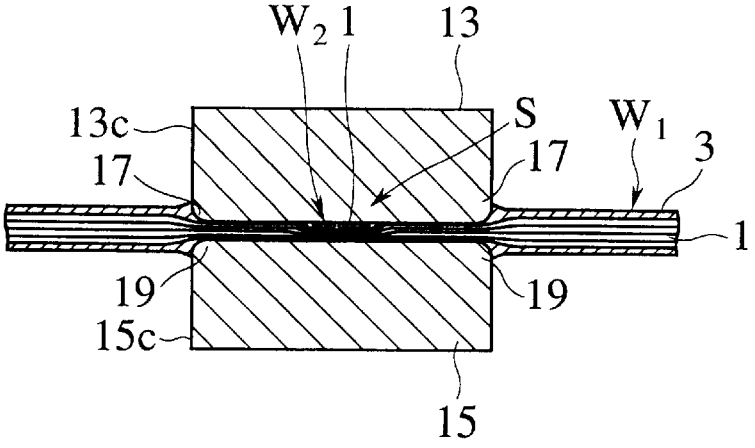
FIG. 4C is a partial cross-section of the structure of FIG. 3 showing a state after connection is completed.

FIG. 1 shows a state in which upper and lower chips are separated from each other, showing a covered wire connection structure according to the instant embodiment and FIG. 2 is a side view of the lower resin chip. FIG. 3 is a perspective view of a state just after connection is started, showing a means for obtaining a connection structure for the covered wires according to the instant embodiment. FIGS. 4A–4C are sectional views taken from the direction of IV in FIG. 3. FIG. 4A shows a state just after connection is started, FIG. 4B shows a state during connection and FIG. 4C shows a state after connection is completed.

According to the instant embodiment shown in FIG. 1, two covered wires W1, W2 each of which comprises a conductive wire portion 1 and a cover portion 3 which is formed of resin and coated around the outer periphery of the conductive wire portion, are conductively connected to each other at connection portions S thereof as shown in FIG. 1.

First, a connection method for the covered wires W1, W2 according to the instant embodiment will be described. For the connection of the two covered wires W1, W2 are used a pair of resin chips 13, 15 serving as a resin material 11, a horn 57 for producing ultrasonic vibration as shown in FIG. 3 and an anvil 59 for supporting the covered wires W1, W2 and the resin chips 13, 15 when the connection between the covered wires is performed. The anvil 59 includes a base stand 61 and a support portion 63 projecting from the base stand 61. The support portion 63 is designed in a substantially cylindrical shape. The support portion 63 has a bore portion 65 which is opened at the opposite side to the base stand side (at the upper side in the same Figure) and has a rectangular cross section. Two pairs of grooves 67, 69 are formed on the peripheral wall of the support portion 63 so as to cross with each other substantially at the center of the bore portion 65. The four grooves 67, 69 are formed so as to open on the same side as the bore portion 65, extending along the projection direction of the support portion 63 and to intercommunicate with one another through the bore portion 65.

The pair of resin chips 13, 15 (see FIG. 1) are designed in a disc shape having a slightly smaller outer diameter than the diameter of the bore portion 65 of the anvil 59. Furthermore, an end portion of a head portion 71 of the horn 57 is designed in a disc shape having an outer diameter which is substantially equal to or slightly smaller than that of the resin chips 13, 15. As material of the resin chips 13, 15 may be used acrylic resin, ABS (acrylonitrile-butadiene-styrene copolymer) resin, PC (polycarbonate) resin, PVC (polyvinyl chloride) resin, PE (polyethylene) resin, PEI (polyetherimide), PBT-G (polyethylene terephtalate containing glass) or the like. Generally, harder material than vinyl chloride or the like for use in the cover portion 3 is utilized. As for adaptability of these resin materials for the resin chips 13, 15, all these resin materials are recognized to be actually effective in terms of conductivity and conductive stability. If judging from appearance and insulation performance as well, particularly the PEI resin and PBT resin are the most suitable.

As shown in FIGS. 1, 2, respective surfaces of the resin chips 13, 15 have melting surfaces 13*a*, 15*a* which are in contact with each other when the resin chips 13, 15 are overlapped with each other In the bore portion 65 of the anvil 59. The connection portion S in which the two covered wires W1, W2 cross each other is located at a central portion of the melting surfaces 13*a*, 15*a*.

In the introducing end portions in which the covered wires W1, W2 are extended out of the resin chips 13, 15, portions of the aforementioned melting surfaces 13*a*, 15*a* out to external peripheral surfaces 13*c*, 15*c* of the respective resin chips 13, 15, are curved surface portions formed with continuously mildly changing curvature. Concretely, between the melting surfaces 13*a*, 15*a* and the external peripheral surfaces 13*c*, 15*c*, round corners (as curved surface portions) 17, 19 providing continuous curvature changing smoothly therebetween are provided. According to the instant embodiment, both the resin chips 13, 15 are provided with the round corners 17, 19, however, it is not necessary to provide both the resin chips with the round corners but it is permissible to provide either of the resin chips 13, 15 with the round corner. Further, although according to the instant embodiment, curved surface portions are provided on the entire circumferences of the round corners 17, 19, it is not always necessary to provide them on the entire circumferences, but the purpose can be attained if this portion is provided in the introducing end portions (four positions in this embodiment).

In order to connect the two covered wires W1, W2 to each other, both of the covered wires W1, W2 are overlapped with each other at the connection portion S thereof and the overlapped connection portions S are pinched by the pair of resin chips 13, 15 from the upper and lower sides of the connection portions. Specifically, one of the resin chips 15 (lower side) is inserted into the bore portion 65 of the anvil 59 such that the melting surface 15*a* thereof is directed upward. Then, one covered wire W1 is inserted into the pair of confronting grooves 67 from the upper side of the inserted resin chip 15. Then, the other covered wire W2 is inserted into the other pair of the confronting grooves 69. Finally, the other (upper side) resin chip 13 is inserted such that the melting surface 13*a* is directed downward. The covered wires W1, W2 are arranged in the bore portion 65 so that the respective connection portions S thereof cross each other at the center of the bore portion 65. Through this arrangement, the connection portions S of the covered wires are pinched substantially at the center of the melting surfaces 13*a*, 15*a* of the upper and lower resin chips 13, 15 respectively in the overlapping direction.

Subsequently, the cover portions 3 at the connection portions S of the covered wires are melted so as to be dispersed by ultrasonic vibration. Furthermore, the conductive wire portions (core) of the covered wires W1, W2 are conductively contacted with each other at the connection portion S by pressurizing the covered wires from the outside of the resin chips 13, 15. Thereafter, the pair of the resin chips 13, 15 are mutually melted at the melting surfaces 13*a*, 15*a* to seal the connection portion S.

Specifically, as shown in FIG. 3, a head portion 71 of the horn 57 is inserted into the bore portion 65 from the upper side of the finally-inserted upper resin chip 13 and the connection portion S is excited and pressurized from the outside of the upper and lower resin chips 13, 15 between the horn 57 and the anvil 59. The pressurizing of the connection portion S is performed by pressurizing the horn 57 toward the anvil 59, and the pressurizing direction is coincident with the overlapping direction of the covered wires.

When the resin materials 11 are melt-fixed to each other by the ultrasonic vibration, the excitation is preferably performed in a direction which substantially perpendicularly intersects to the connection surface of the resin materials 11 because it provides the most excellent melt-fixing state. Therefore, the direction of the excitation of the connection portion S is set to a direction which crosses the confronting surfaces 13*a*, 15*a* of the resin chips, that is, it is set to be coincident with the overlapping direction of the covered wires W1, W2. With this arrangement, longitudinal vibration is produced from the horn 57.

When the connection portion S is pressurized and excited in the above state, as shown in FIG. 4C, the cover portions 3 are first melted and the conductive wire portions 1 of the covered wires W1, W2 are exposed at the connection portion S between the resin chips 13 and 15. At this time, the melted cover portions 3 are extruded from the center of the resin chips 13, 15 toward the outside thereof because the connection portions S are pressurized from the upper and lower sides, so that the conductive wire portions 1 are more excellently exposed and surely conductively contacted with each other. Like the pressurizing direction, the direction of the excitation of the connection portions S is set to be coincident with the overlapping direction of the covered wires W1, W2, so that the action of extruding the melted cover portions 3 from the center of the resin chips 13, 15 to the outside thereof is promoted.

When the pressurizing and exciting operation on the connection portions S is further continued after the melting of the cover portions 3, the resin chips 13, 15 are melted and the confronting melting surfaces 13*a*, 15*a* of the resin chips 13, 15 are melted to each other. In addition, the outer peripheral surface portions of the cover portions 3 which are adjacent to the conductively contacted conductive wire portions 1 and the resin chips 13, 15 are melt-fixed. With this operation, the outer peripheral portions of the conductively contacted conductive wire portions 1 are kept to be coated with the resin chips 13, 15.

If the introducing end portions of the resin chips 13, 15 are strongly pressurized against the aforementioned exposed conductive wire portion 1 by increasing the pressurizing and excitation force to secure a sufficient melting force, the conductive wire portion 1 can be prevented from being damaged when the resin chips 13, 15 are melted together, because, in the introducing end portions, the round corners 17, 19 having a curvature changing smoothly are provided in ranges between the melting surfaces 13*a*, 15*a* and the external peripheral surfaces 13*c*, 15*c*, such that the round corners 17, 19 are in contact with the conductive wire portion 1 (see FIG. 4*c*).

According to the connection method of the instant embodiment, the covered wires W1,W2 are overlapped with each other at the connection portion S and with the connection portion S being pinched by the pair of the resin chips 13, 15, the cover portion 3 is pressurized from the outside of the resin chips 13, 15 so as to be dispersed and melted. Then, the covered wires W1, W2 can be conductively contacted with each other at the connection portion S. Thus, it is not necessary to remove the cover portions 3 to make the covered wires W1, W2 conductively contacted with each other, and thus it is possible to make them conductively contacted with each other by a simple operation.

Further, after the covered wires W1, W2 are conductively contacted with each other at the connection portion S, the upper and lower resin chips 13, 15 are melted together to seal the connection portion S. Thus, a high mechanical strength can be obtained at the connection portion S by the melted and hardened resin chips 13, 15.

Because the resin chips 13, 15 have only to have a dimension capable of pinching the connection portion S conductively contacted from the upper and lower sides of the resin chips 13, 15, a range required for connection can be suppressed to a small range. Further, because the connection portion S is sealed by the resin chips 13, 15, it is possible to secure a sufficient insulation performance.

Thus, by a high mechanical strength and a sufficient insulation performance, it is possible to stabilize the conductive characteristic between the covered wires W1 and W2 at the connection portion S.

The connection method according to the present embodiment is a relatively simple method in which the overlapped connection portions S are pinched by the resin chips 13, 15 and the connection portions S are pressurized and excited between the horn 57 and the anvil 59 from the outside of the resin chips 13, 15. Further, the connection method and structure according to the instant embodiment do not restrict one covered wire W1 and the mating member to be conductively connected therewith (the other covered wire W2 in the instant embodiment) to any particular shape. Thus, this connection method and structure can be applied to various connections such as connection of the covered wires W1, W2 with terminals thus obtaining a wide availability.

Furthermore, the covered wires W1, W2 are pinched by the pair of the resin chips 13, 15 in the overlapping direction thereof and the connection portions S are pressurized and excited between the horn 57 and the anvil 59 from the outside of the resin chips 13, 15 and the direction of the pressurizing is set to the same as the direction in which the covered wires W1,W2 are overlapped with each other. Thus, when the connection portion S is pressurized, the melted cover portions 3 are extruded out from the center portion of the resin chips 13, 15 so that the conductive wire portions 1 are exposed excellently thereby obtaining a secure conductive contacting state. Further, because the direction of excitation to the connection portion S is set to the same as the direction in which the covered wires W1, W2 are overlapped with each other like the pressurizing direction, it is possible to obtain excellent melting condition of the resin chips 13, 15 and enhance an action of pushing out the cover portions 3.

Further, because, in the introducing end portions, the round corners 17, 19 are formed so as to continuously change smoothly in ranges between the melting surfaces 13*a*, 15*a* and the external peripheral surfaces 13*c*, 15*c*, it is possible to prevent the conductive wire portions 1 from being damaged even if the introducing end portions are strongly pressurized by the conductive wire portion 1 when the resin chips 13, 15 are melted together by increasing the pressurizing and excitation force to secure a sufficient melting force. Thus, it is not necessary to set a melting condition (e.g., ultrasonic energy, pressure, and pressurizing and excitation time, etc.) for pressurizing and excitation in details and manage it. With a simple operation, it is possible to prevent the conductive wire portion from being damaged and secure a sealing condition of the resin chips 13, 15.

It is permissible to use the resin chips 13, 15 having a relatively low viscosity at the time of melting. Then, when melting the resin chips 13, 15 so as to surround the connection portion S, the melted resin chips 13, 15 may be filled in gaps between plural core wires composing the conductive wire portion 1 in the neighboring conductive wire portions 1 excluding the connection portion S to fill gaps formed between the cover portions of the covered wires W1,W2 and the core wires or gaps formed between the core wires with resin material 11 thereby obtaining an effect of sealing against water inside of the covered wires W1, W2. Thus, for example, in a case in which one end of the covered wires W1, W2 is connected to a portion requiring waterproofing (waterproofed portion) and the other end thereof is connected to a portion not requiring water proofing (non-waterproofed portion), water or the like enters inside of the covered wires W1, W2 from the other end due to capillary phenomenon and flows inside of the covered wires W1, W2. However, water is prevented from entering to the one end by the aforementioned effect of sealing against water. Thus, it is possible to secure water proof performance at the one end without providing the other end with water proof structure. That is, if both ends of the covered wires W1,W2 are connected to the water proofed portion and the non-waterproofed portion, it is possible to secure waterproof performance in the waterproofed portion without providing the non-waterproofed portion with a waterproofing structure, by a simple and cheap method and structure.

Next, a second embodiment of the present invention will be described with reference to the accompanying drawings.

Figure 5:
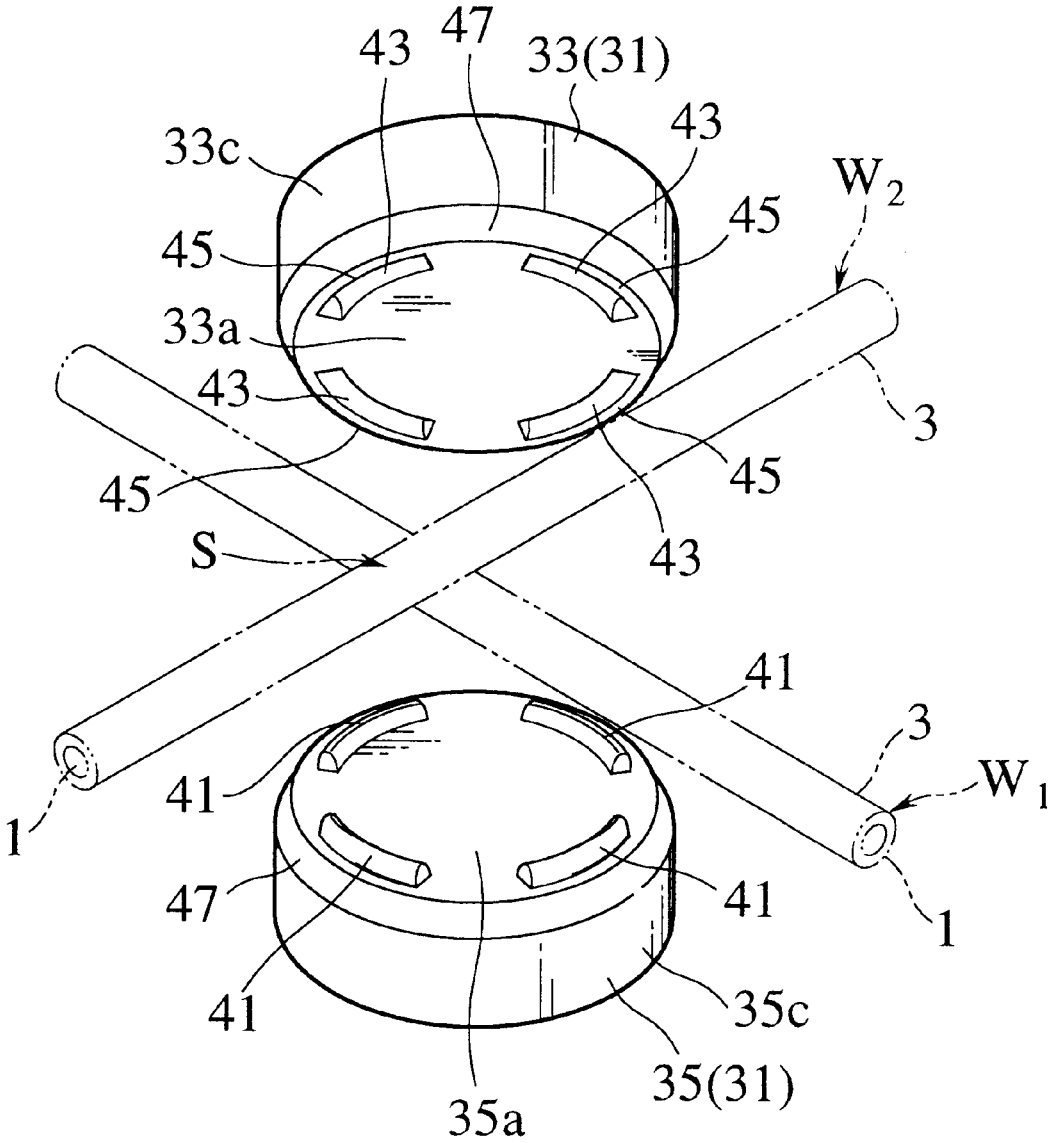
FIG. 5 is a perspective view of a state in which the upper and lower resin chips are separated showing a covered wire connection structure according to a second embodiment of the present invention.
Figure 6:
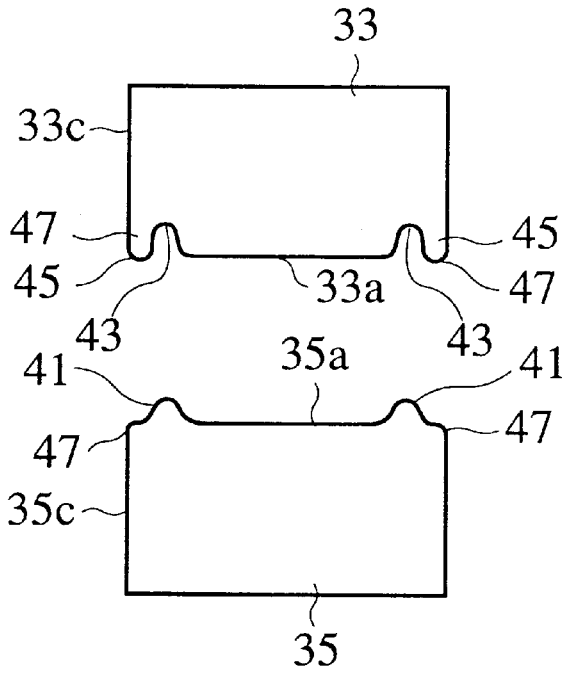
FIG. 6 is a side view of the upper and lower resin chips according to the second embodiment.
Figure 7:
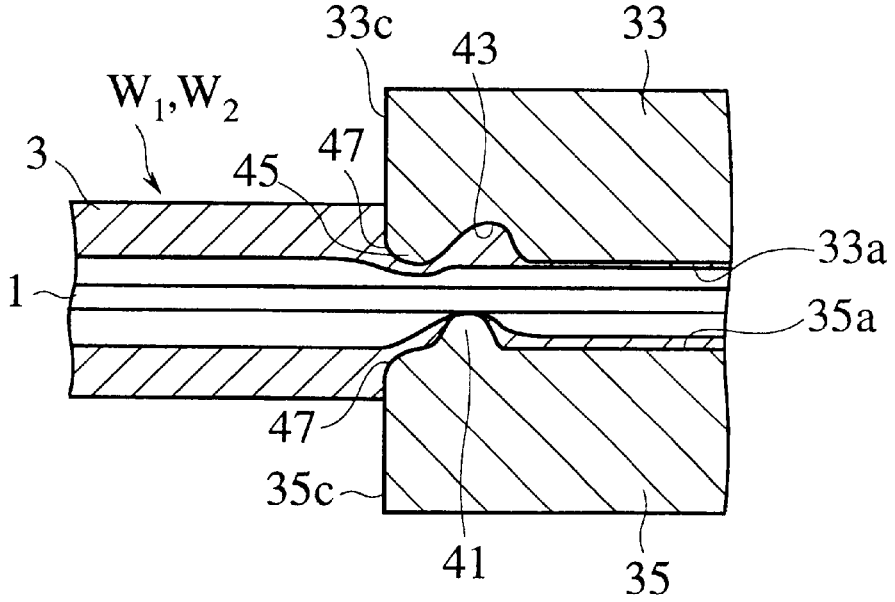
FIG. 7 is an enlarged side view of a major part indicating the covered wire connection structure according to the second embodiment.

FIG. 5 is a perspective view of a state in which the upper and lower resin chips are separated, showing a covered wire connection structure according to the instant embodiment. FIG. 6 is a side view of upper and lower resin chips. FIG. 7 is an enlarged side sectional view of a major portion showing a covered wire connection structure according to the instant embodiment. Meanwhile, the same reference numeral is attached to the same component as in the first embodiment, and a description thereof is omitted.

As shown in FIGS. 5, 6, a pair of the resin chips 33, 35 which serves as the resin material 31 according to the instant embodiment are formed in a disc shape having a slightly smaller outside diameter than the internal diameter of the anvil like in the first embodiment. The resin chips 33, 35 have melting surfaces 33*a*, 35*a* respectively which are contacted with each other when the resin chips 33, 35 are overlapped with each other in the bore of the anvil and the connection portion S in which two covered wires W1, W2 cross each other is located in the center of the melting surfaces 33*a*, 35*a*.

Resin projecting portions 41, 45 are formed in the introducing end portions in which the covered wires W1, W2 are introduced out of the resin chips 33, 35. The resin projecting portions 41, 45 project toward a mating resin chip for pressurizing the cover portions 3 of the covered wires W1, W2 in the introducing end portion sides when the resin chips 33, 35 are pressurized and excited. The upper and lower resin projecting portions 41, 45 are provided such that they are deviated from each other on the resin chips 33, 35 so that one portion (upper side) is located at the outside (side of the outer peripheral surface 33*c*) and the other portion (lower side) is located at the inside (side of the center of the melting surface 35*a*). Concretely, the lower resin projecting portion 41 is provided so as to project from the melting surface 35*a* in the introducing end portions (four positions) of the lower resin chip 35. Four resin projecting portion containing concave portions 43 for containing the lower resin projecting portions 41 are provided on the melting surface 33*a* of the upper resin chip 33 such that they correspond to the lower resin projecting portions 41. Then, thin portions on the external side of the resin projecting portion containing concave portions 43 constitute the upper resin projecting portions 45. Although according to the instant embodiment, the resin projecting portions 41, 45 are provided only in the respective introducing end portions of the upper and lower resin chips 33, 35, it is permissible to provide an annular resin projecting portion.

In the introducing end portions, portions from the melting surfaces 33*a*, 35*a* of the upper and lower resin chips 33, 35 to the outer peripheral surfaces 33*c*, 35*c* are formed in a shape of curvature continuously changing smoothly. Concretely, in the introducing end portions of the upper resin chip 33, the curvature portions from the melting surface 33*a* to the outer peripheral surface 33*c* through the resin projecting portion containing concave portions 43 and the resin projecting portions 45 are formed. Particularly between the outer peripheral surface 33*c* and the resin projecting portion 45, the round corner (as curved surface portion) 47 is provided. In the introducing end portions of the lower resin chip 35, the curvature portion from the melting surface 35*a* to the outer peripheral surface 35*c* through the resin projecting portion 41 is formed. Particularly between the resin projecting portion 41 and the outer peripheral portion 35*c*, the round corner 47 is formed like the upper side.

In this connection structure, it is possible to obtain conductive connection by a simple operation like the first embodiment. At the connection portions S, a high mechanical strength is obtained so that conductive characteristic of the connection portions S between the covered wires W1 and W2 can be stabilized by the high mechanical strength and a sufficient insulation performance.

Further, because the resin projecting portions 45, 41 are provided in the introducing end portions of the resin chips 33, 35, as shown in FIG. 7, ultrasonic waves are concentrated to the resin projecting portions 45, 41 when the resin chips 33, 35 are melted, so that the resin projecting portions 45, 41 are softened by heat generated inside. Thus, if the pressurizing and excitation force is increased to secure a sufficient melting force so that the introducing end portions are strongly pressurized by the conductive wire portion 1 when the resin chips 33, 35 are melted, the conductive wire portion 1 can be prevented from being damaged because the softened resin projecting portions 45, 41 are in contact with the conductive wire portion 1.

Further, because the portions from the melting surfaces 33*a*, 35*a* in the introducing end portions of the resin chips 33, 35 to the outer peripheral surfaces 33*c*, 35*c* are formed in a shape of curvature continuously changing smoothly, the same effect as the first embodiment can be obtained so that the conductive wire portion 1 can be prevented from being damaged.

Thus, it is not necessary to set a melting condition by pressurizing and excitation (e.g., ultrasonic energy, pressure, pressurizing and excitation time, etc.) in details and manage it, and it is possible to prevent the conductive wire portion from being damaged by a simple operation and further secure a sealing condition of the resin chips 33, 35.

What is claimed is:

1. A covered wire structure for electrically connecting conductive members, at least one of the members being a covered wire having a conductive wire portion and a cover portion formed by coating resin around an outer periphery of the conductive wire portion, said structure being formed by overlapping said members with each other and pinching an overlapping portion of said members between a pair of resin chips, pressurizing and exciting said overlapping portion pinched by said resin chips using an ultrasonic vibration welding apparatus so as to melt and disperse said cover portion, thereby to expose the conductive wire portion and electrically connect the conductive wire portion of said at least one member with another of the members at said overlapping portion and so as to melt-fix said pair of resin chips to seal the overlapping portion of said members with said resin chips, wherein:

each of said resin chips includes a melting surface facing the other resin chip and an introducing end portion from which said covered wire extends out of the resin chips, at least one of said resin chips has a curved surface portion in the introducing end portion thereof, and said curved surface portion continuously changes smoothly and is formed between said melting surface and an outer peripheral surface of said at least one of said resin chips.

2. A covered wire connection structure for electrically connecting conductive members, at least one of the members being a covered wire having a conductive wire portion and a cover portion formed by coating resin around an outer periphery of the conductive wire portion, said structure being formed by overlapping said members with each other and pinching an overlapping portion of said members between a pair of resin chips, pressurizing and exciting said overlapping portion pinched by said resin chips using an ultrasonic vibration welding apparatus so as to melt and disperse said cover portion, thereby to expose the conductive wire portion and electrically connect the conductive wire portion of said at least one member with another of the members at said overlapping portion and so as to melt-fix said pair of resin chips to seal the overlapping portion of said members with said resin chips, wherein:

each of said resin chips includes an introducing end portion from which said covered wire extends out of the resin chips, at least one of said resin chips has a resin projecting portion in the introducing end portion thereof, and said resin projecting portion projects toward the other resin chip and pressurizes said cover portion on the introducing end portion when said resin chips are pressurized and excited.

3. A covered wire connection structure according to claim 2 wherein each of said resin chips has said resin projecting portion in the introducing end portion thereof, and said resin projecting portions are deviated from each other.

4. A covered wire connection structure according to either of claims 2 or 3 wherein at least one of said resin chips has a curved surface portion in the introducing end portion thereof, and said curved surface portion continuously changes smoothly and is formed between a melting surface facing the other resin chip and an outer peripheral surface of said at least one of said resin chips.

5. A covered wire connection structure according to claim 1 wherein at least one of said resin chips has a resin projecting portion in the introducing end portion thereof, and said resin projecting portion projects toward the other resin chip and pressurizes said cover portion on the introducing end portion of the other resing chip when said resin chips are pressurized and excited.

6. A covered wire connection structure according to claim 5 wherein each of said resin chips has said resin projecting portion in the introducing end portion thereof, and said resin projecting portions are deviated from each other.

7. A covered wire connection structure for electrically connecting conductive members, at least one of the members being a covered wire having a conductive wire portion and a cover portion formed by coating resin around an outer periphery of the conductive wire portion, the structure being formed by overlapping the members with each other and pinching an overlapping portion of the members between a pair of resin chips, pressurizing and exciting the overlapping portion pinched by the resin chips using an ultrasonic vibration welding apparatus so as to melt and disperse the cover portion, thereby to expose the conductive wire portion and electrically connect the conductive wire portion of the at least one member with another of the members at the overlapping portion and so as to melt-fix the pair of resin chips to seal the overlapping portion of the members with the resin chips, wherein:

each of the resin chips includes an introducing end portion from which the covered wire is extended out of the resin chips, at least one of the resin chips has a resin projecting portion in the introducing end portion thereof, the resin projecting portion projects toward the other resin chip and pressurizes the cover portion on the introducing end portion of the other resin chip when the resin chips are pressurized and excited, and ultrasonic waves from the ultrasonic vibration welding apparatus are concentrated to the resin projecting portion.

8. A covered wire connection structure according to claim 7 wherein each of the resin chips has the resin projecting portion in the introducing end portion thereof, and the resin projecting portions are deviated from each other.

9. A covered wire connection structure according to claim 2 wherein each of said resin chips is circular and has said resin projecting portion in the introducing n portion thereof, and said resin projecting portions are offset radially from each other.

10. A covered wire connection structure according to claim 7 wherein each of the resin chips is circular and has the resin projecting portion in the introducing end portion thereof, and the resin projecting portions are offset radially from each other.

* * * * *

UNITED STATES PATENT AND TRADEMARK OFFICE

CERTIFICATE OF CORRECTION

PATENT NO.: 5,922,993

DATED: JULY 13, 1999

INVENTOR: Tetsuo IDE and Nobuyuki ASAKURA

It is certified that an error appears in the above-identified patent and that said Letters Patent is hereby corrected as shown below:

Claim 5, column 10, line 66, "resing" should read --resin--.

Claim 9, column 12, line 16, "n portion" should read --end portion--.

Signed and Sealed this

Eighteenth Day of April, 2000

*Attest:*

Q. TODD DICKINSON

*Attesting Officer*

*Director of Patents and Trademarks*